US006764141B2

(12) United States Patent
O'Neill

(10) Patent No.: US 6,764,141 B2
(45) Date of Patent: Jul. 20, 2004

(54) REAR MOUNTED BIT HOLDER WATER SPRAY

(75) Inventor: Michael L O'Neill, Lucinda, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 60 days.

(21) Appl. No.: 10/324,347

(22) Filed: Dec. 19, 2002

(65) Prior Publication Data

US 2004/0119327 A1 Jun. 24, 2004

(51) Int. Cl.[7] ..... E21C 35/187
(52) U.S. Cl. ..... 299/81.3; 299/81.1
(58) Field of Search ..... 299/81.3, 81.1, 299/39.8; 175/340, 393, 429

(56) References Cited

U.S. PATENT DOCUMENTS

| | | | | | |
|---|---|---|---|---|---|
| 4,389,075 | A | * | 6/1983 | Kogler | 299/81.3 |
| 4,573,744 | A | * | 3/1986 | Clemmow et al. | 299/81.3 |
| 4,650,253 | A | * | 3/1987 | Clemmow et al. | 299/81.3 |
| 4,842,337 | A | * | 6/1989 | Southern | 299/81.3 |
| 5,378,048 | A | * | 1/1995 | Parrott | 299/81.3 |
| 6,257,672 | B1 | * | 7/2001 | Parrott | 299/81.3 |
| 6,536,847 | B2 | * | 3/2003 | Clapham et al. | 299/81.2 |

FOREIGN PATENT DOCUMENTS

| | | | | |
|---|---|---|---|---|
| DE | 1272257 | * | 7/1968 | E21C/35/187 |
| DE | 2221540 | * | 11/1973 | E21C/35/187 |
| SU | 613032 | * | 6/1978 | E02F/5/30 |

* cited by examiner

*Primary Examiner*—David Bagnell
(74) *Attorney, Agent, or Firm*—James Earl Lowe, Jr.

(57) ABSTRACT

An assembly for mounting a cutter bit on a driven mechanism, the assembly comprising a bit having a bit tip, a bit sleeve including a holding portion adapted to receive the bit, a bore through the holding portion, and a bit holder. The assembly further includes a mounting base having a forward portion and a mounting base rear portion having an internal water passageway in communication with an upper opening for receiving an ignition control unit. The assembly further includes a rear surface having a spray nozzle cavity in the rear surface and open in a rearward direction. The spray nozzle cavity has an internal spray nozzle cavity water passageway-in communication with the mounting base rear portion internal water passageway. The assembly further includes a dust reduction unit including a spray nozzle comprising a base received in the spray nozzle cavity, the base having a spray nozzle base water passageway through the spray nozzle base and in communication with the spray nozzle receptacle water passageway. The dust reduction unit further includes a spray orifice in communication with the spray nozzle base water passageway, and a mechanism for connecting the spray nozzle to the mounting base rear portion.

11 Claims, 4 Drawing Sheets

REAR MOUNTED BIT HOLDER WATER SPRAY

BACKGROUND OF THE INVENTION

The present invention relates to material removing tools in general, and more particularly to improvements in rotary cutters. Still more particularly, the invention relates to rotary cutters of the type wherein a rotor is driven by a shaft and carries a plurality of external material removing bits as well as a plurality of external nozzles serving to direct sprays of a fluid medium (normally water) against the mine face and/or against the bits.

Longwall drums and continuous miner cutter drums often include water sprays built into them. One purpose of the water sprays is for control of airborne dust generated by the cutting action of the bits. This purpose is usually performed by a spray located in front of each bit. A second purpose is to avoid methane ignition due to the friction of the bit striking rock. This is usually performed by a spray located high on the rear of the bit holder, spraying on the back of the bit and the coal or rock face where the bit has just passed through.

The spray located in front of each bit has usually been mounted directly on the drum scroll, between the bit holders. This requires drilling holes down into the drum's water passages, and welding on spray housings into which fit the spray nozzles themselves. This is expensive and difficult to weld due to limited accessibility. The number of bits on the drum must sometimes be compromised to provide space for the drum-mounted water sprays.

SUMMARY OF THE INVENTION

One of the objects of the invention is to provide a water spray for controlling airborne dust that does not require added space between the bit holders.

Another of the objects of the invention is to provide a water spray for controlling airborne dust that does not require drilling additional holes into the water passageways in the drum.

This invention provides a bit holder already having an integral water passage for a frictional ignition control spray, with a dust control spray by mounting a spray on the rear of each bit holder, thus utilizing water from the bit holder's integral water passage to spray on the front of the bit of the next bit holder behind it.

More particularly, this invention provides an assembly for mounting a cutter bit on a driven mechanism, the assembly comprising a bit having a bit tip, a bit sleeve including a holding portion adapted to receive the bit, a bore through the holding portion, and a bit holder. The assembly further includes a mounting base having a forward portion and a mounting base rear portion having an internal water passageway in communication with an upper opening for receiving an ignition control unit. The assembly further includes a rear surface having a spray nozzle cavity in the rear surface and open in a rearward direction. The spray nozzle cavity has an internal spray nozzle cavity water passageway in communication with the mounting base rear portion internal water passageway. The assembly further includes a dust reduction unit including a spray nozzle comprising a base received in the spray nozzle cavity, the base having a spray nozzle base water passageway through the spray nozzle base and in communication with the spray nozzle receptacle water passageway. The dust reduction unit further includes a spray orifice in communication with the spray nozzle base water passageway, and means for connecting the spray nozzle to the mounting base rear portion.

This invention provides a significant reduction in cost, when compared to other airborne dust control sprays. The necessary machining is much less expensive on a small bit holder than on a large drum. Further, the bit holders are already machined on computer numerical controlled (CNC) equipment, so the additional machining can be done by the CNC equipment with little added cost. The spray also has the ability to be aimed properly at an adjacent bit with a simple alignment jig, and fixed in that position by welding or clamping. Further, mounting the bit nozzle behind the bit holder reduces the amount of mined material contact with the spray nozzle, thereby increasing the spray's service life.

Figure 1:
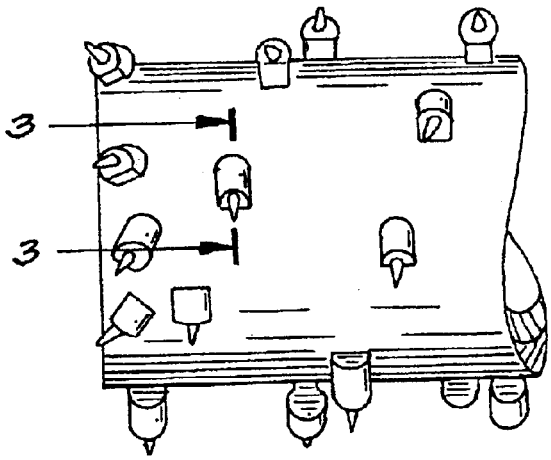
FIG. 1 is a top partial view of rotary cutter.
Figure 2:
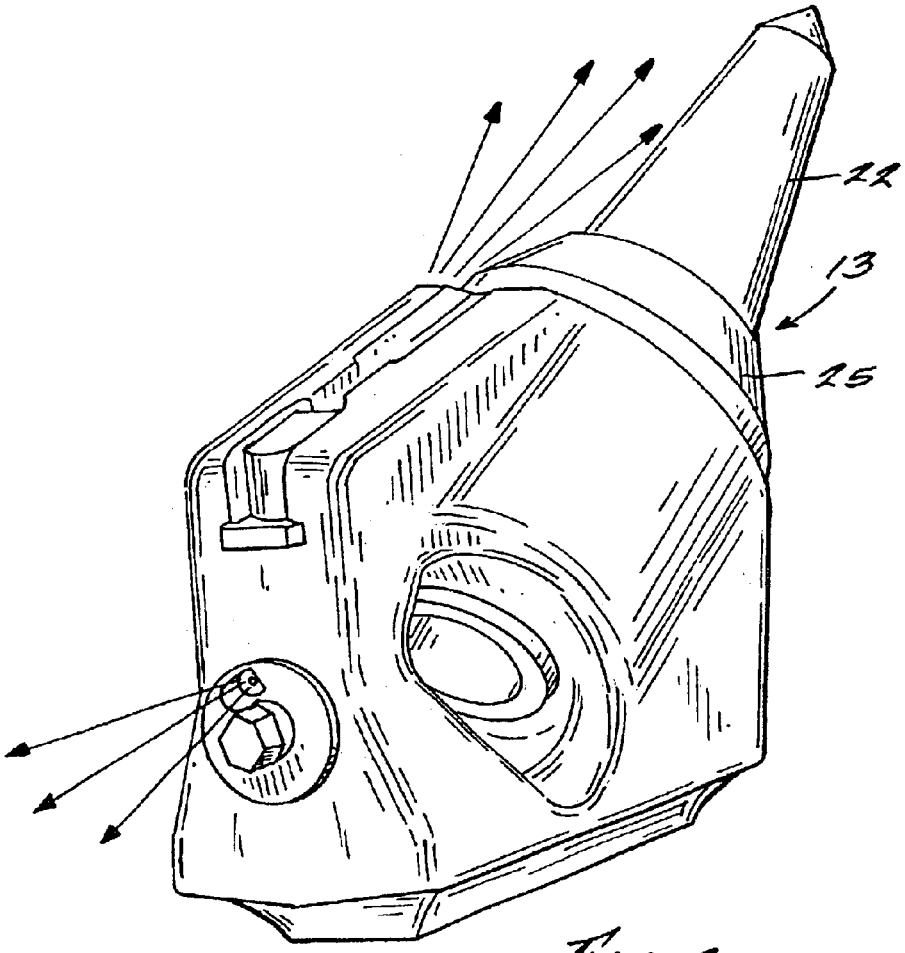
FIG. 2 is a perspective view of one of the bit holders shown in FIG. 1, with one embodiment of a rear mounted spray according to this invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward"and "downward", etc., are words of convenience and are not to be construed as limiting terms.

DESCRIPTION OF A PREFERRED EMBODIMENT OF THE INVENTION

In the process of mining, a metal cutter bit 12 and bit holder assembly 13 is secured to a cutting drum 11, and the cutting drum 11 is advanced into contact with a surface to a partial section of a mining drum 11 with a number of cutter bits 12 attached to the periphery. The cutter bits 12 form an assembly 14 that is placed in spaced relationship around the drum 11. The cutter drum 11 shows sixteen bit holder assemblies 13 and at least five repeating positions for attachment of the bit assemblies. It is to be understood that additional bit assemblies can be attached to the drum in varying spaced relationship.

Each bit assembly 13 is secured to the drum 11 by a known means, such as, for example, welding. While the bit assemblies 13 are shown mounted on a drum in FIG. 1, it is to be understood that such bit assemblies may be mounted on other mining machines such as for example cutter chains, conical head cutters, shearing machines, or mining heads.

Figure 3:
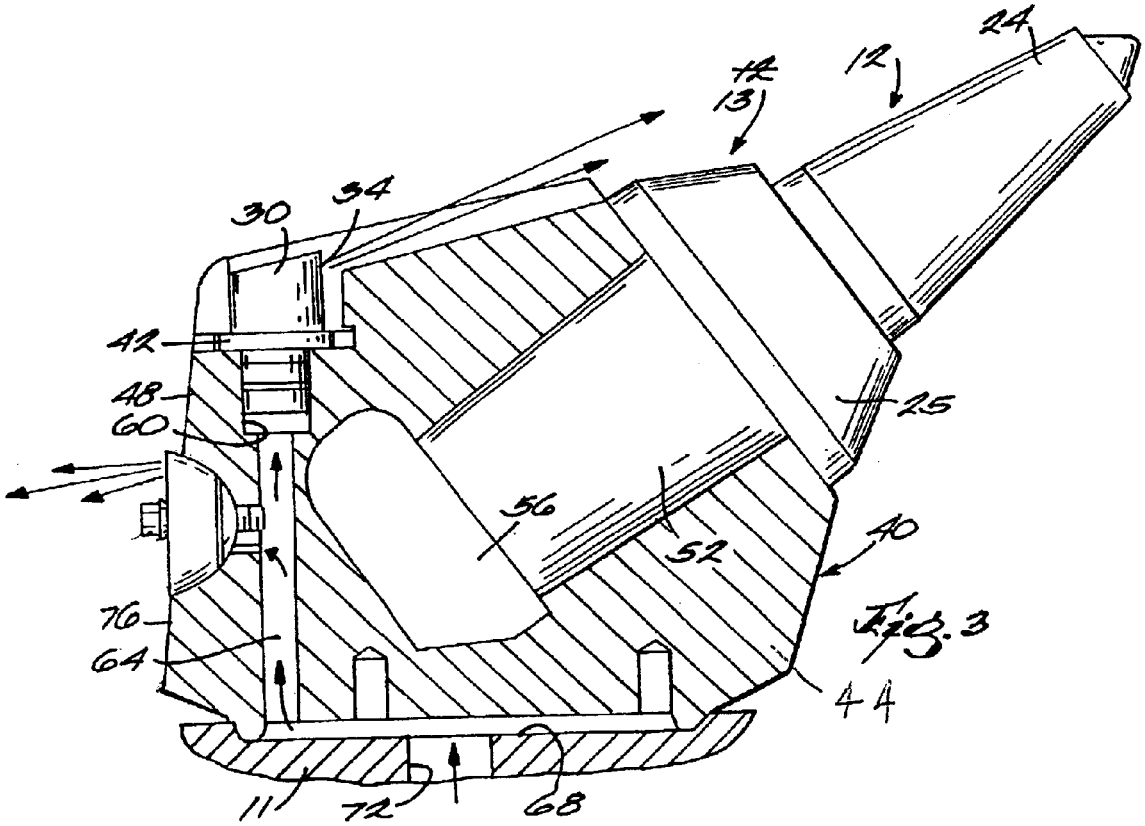
FIG. 3 is a partial cut away view of the bit holder of FIG. 2 taken along the line 3—3 in FIG. 1.

More particularly, as shown in FIG. 3, the bit assembly 13 comprises a bit 12 having a bit tip 24, and a bit sleeve 25. The bit sleeve 25 includes a holding portion adapted to receive the bit 12, and a bore through the holding portion. The bit assembly 13 also includes an ignition control unit 30 including a spray outlet 34 having an internal bore (not shown). In other embodiments, sleeveless bit assemblies (not shown) can be used.

The bit assembly 13 also includes a bit holder 40 including a mounting base, and means for releasably securing the ignition control unit 30 to the rear portion in the form of a retainer or clip 42. The mounting base has a forward portion 44 and a mounting base rear portion 48.

The mounting base forward portion 44 has an upwardly open socket 52 adapted to receive the bit sleeve 25 so that the bit tip 24 extends in a forward direction, and an opening 56 to the interior end of the upwardly open socket to assist in removal of the bit sleeve 25. The mounting base rear portion 48 has an upper opening 60 that receives the ignition control unit 30, and an internal water passageway 64 in communication with the upper opening 60. The base rear portion 48 also has an external grove 68 in communication with a drum internal passageway 72 in the drum 11. As is known in the art, a fluid such as water within the drum 11 flows out of the drum passageway 72, through the drum external groove 68, and then through the internal water passageway 64 to the upper opening 60. From there, the water passes through the ignition control unit 30, where the water is then sprayed on the surface being mined. In other embodiments (not shown), the internal water passageway 64 can not have an upper opening 60, and the ignition control unit 30 can be omitted.

Figure 4:
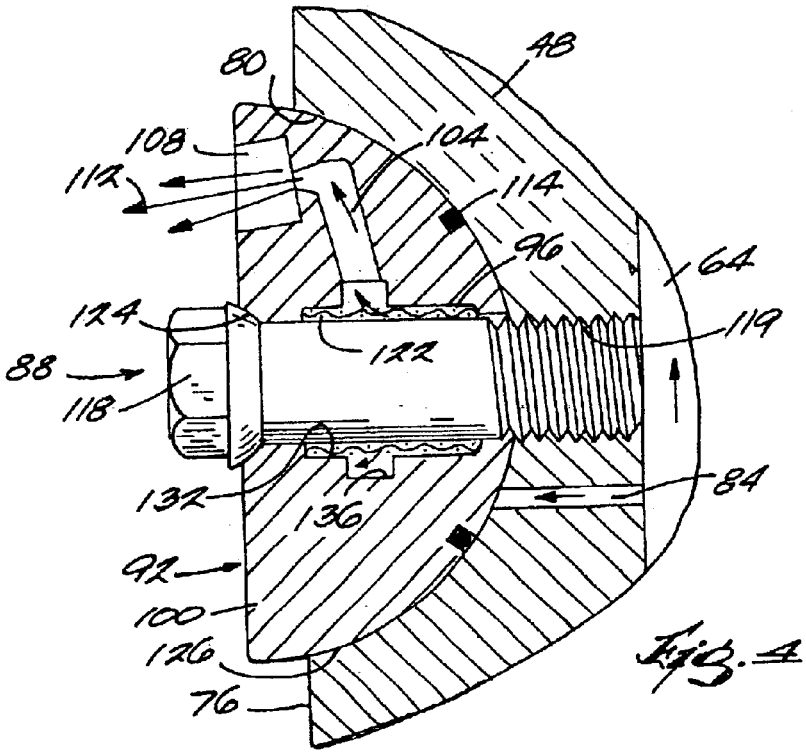
FIG. 4 is an enlarged cut away view of the rear mounted nozzle shown in FIG. 2.
Figure 5:
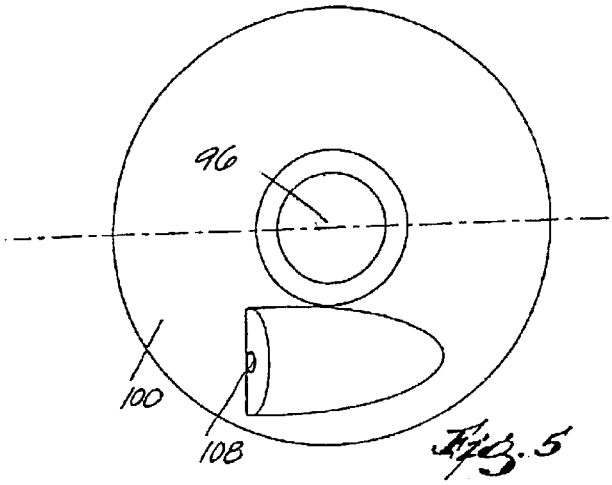
FIG. 5 is a top view of another embodiment of the rear mounted spray nozzle of FIG. 2.
Figure 8:
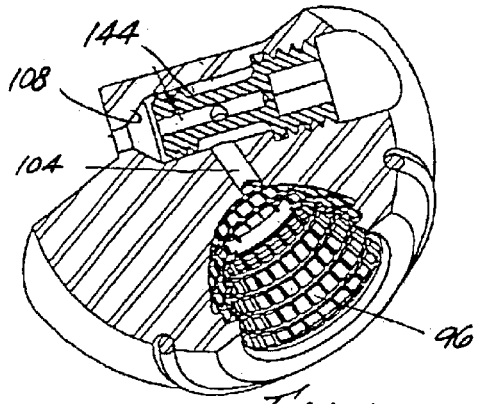
FIG. 8 is a cross-sectional view of the spray nozzle of FIG. 5 taken along the line 8—8 in FIG. 7.
Figure 6:
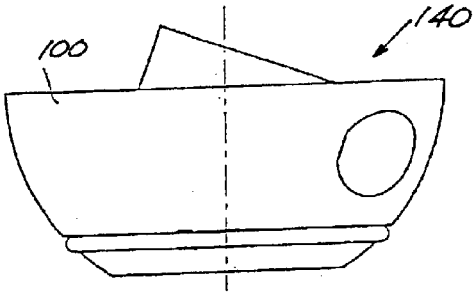
FIG. 6 is a side view of the spray nozzle shown in FIG. 5.
Figure 7:
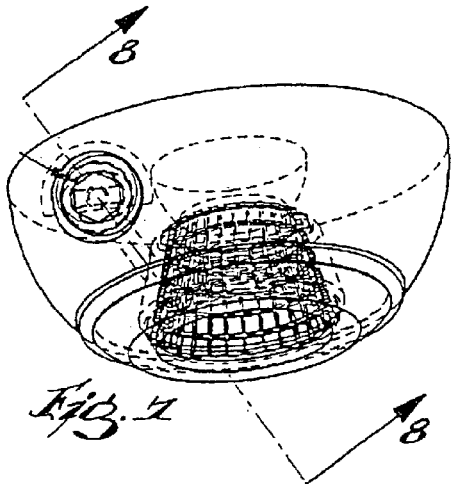
FIG. 7 is a side view partially in ghost of the spray nozzle shown in FIG. 5.

As shown in FIG. 4, the mounting base rear portion 48 also has a rear surface 76 having a spray nozzle cavity 80 open in a rearward direction. The spray nozzle cavity 80 has an internal spray nozzle cavity water passageway 84 in communication with the mounting base rear portion internal water passageway 64.

The bit assembly 13 further includes a dust reduction unit 88 including a spray nozzle 92 having a spray nozzle base bore 96, a base 100 received in the spray nozzle cavity 80, and a spray nozzle base water passageway 104 through the spray nozzle base 100 and in communication with the spray nozzle cavity water passageway 84. The dust reduction unit 88 further includes a spray orifice 108 in communication with the spray nozzle base water passageway 104. The spray nozzle 92 is rotatable in the spray nozzle cavity 80 so that the spray orifice 108 can be directed toward a particular direction before the spray nozzle is fixed in place. A simple alignment jig (not shown) can be used to position the spray nozzle 108 in the proper location so that the dust reduction water spray 112 can be directed toward the next bit assembly 13 on the drum 11.

The dust reduction unit further includes a seal 114 between the spray nozzle base 100 and the spray nozzle cavity 80, and means for connecting the spray nozzle 92 to the mounting base rear portion 48 in the form of a bolt 118 passing through the spray nozzle base bore 96 and secured in a threaded opening 119 in the mounting base rear portion 48. A filter screen 122 is also located between the spray nozzle cavity 80 and the spray nozzle base water passageway 104.

The spray base 100 has spherical surface 126 on one end. Still more particularly, the face of the spray base 100 that faces rearward includes a spherical socket 124 concentric with the bolt hole and with the spherical end surface 126. The bolt 118 has a bolt head with a spherical surface that fits the socket 124. The bolt's spherical surface could be integral to the bolt or made as a spherical washer on a standard bolt.

The spherical surface 126 of the spray base 100 fits into the spherical spray nozzle cavity 80 in the bit holder rear portion 48. The spherical shape of the base 100 and the cavity 80 allows for the spray 112 to be aimed in a wide range of orientations to point at the next bit. The spray base 100 is then clamped in place by tightening the bolt 118.

Water is provided to the inner portion of the spherical cavity 80 of the bit holder by the water passageway 84 to the bit holder's integral water cavity passageway 64. The passageway 84, in the preferred embodiment, is a separate channel in the base 100. In other embodiments (not shown), the rear portion threaded opening 119 could be loose and permit water to pass around the bolt 118. In still other embodiments (not shown), the passageway 84 could be a hollow bolt with a side hole to direct water to the spray orifice 108. An undercut 132 is provided into the bolt hole bore 96, into which fits the filter screen. 122 to trap particles that could plug the orifice. A groove 136 is provided under the screen 122 to channel water to the passageway 104 leading to the orifice 108.

The base spherical rear surface 126 radius of curvature is larger than the spray cavity 80 radius of curvature so that water can communicate from the water passageway 84 to the base bore 96. Water passing around the bolt 118 then communicates with the spray nozzle base water passageway 104.

FIGS. 5 through 8 illustrate another embodiment of the spray nozzle 92 shown in FIGS. 1 through 4. Like parts from the earlier embodiment are labeled with the same numbers for ease of reference.

More particularly, this embodiment of a spray nozzle 140 includes an improvement to the spray nozzle opening 108 shown in FIGS. 1 through 4. The nozzle opening 108 has located therein a swirler 144 in communication with the nozzle base water passageway 104. The swirler, as is known in the art, makes a portion of the water go through a helical path to give the spray some angular momentum as it is ejected. This in turn is what causes it to expand into a conical pattern. In other embodiments, other methods of creating a conical spray pattern can be used.

Figure 9:
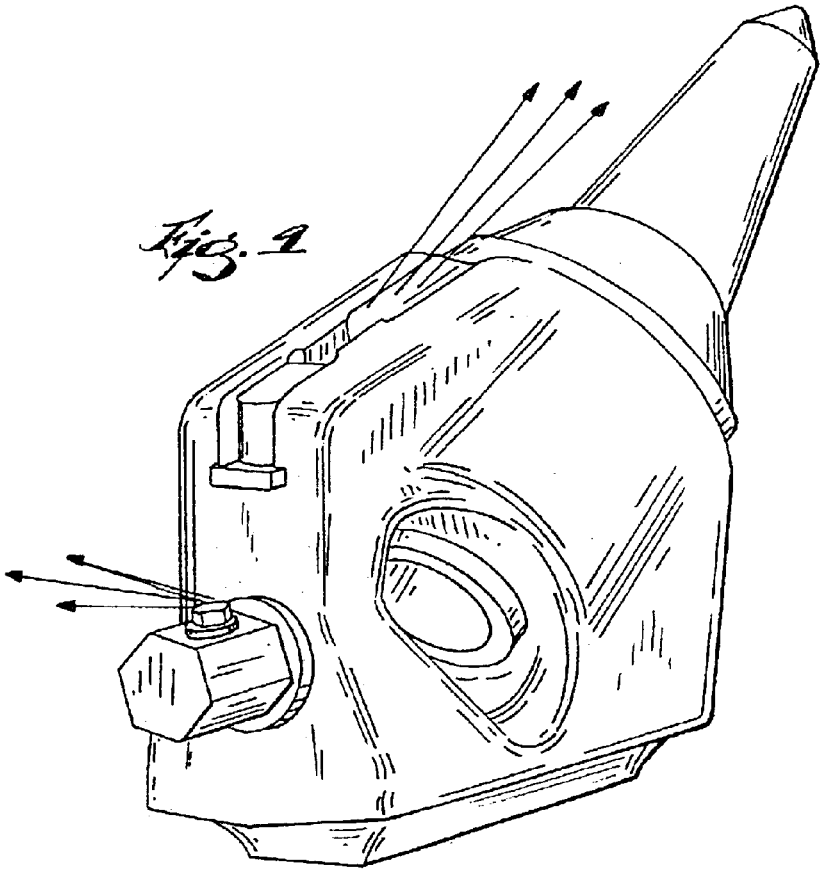
FIG. 9 is a perspective view of the bit holder of FIG. 2 with another embodiment of the rear mounted spray.
Figure 10:
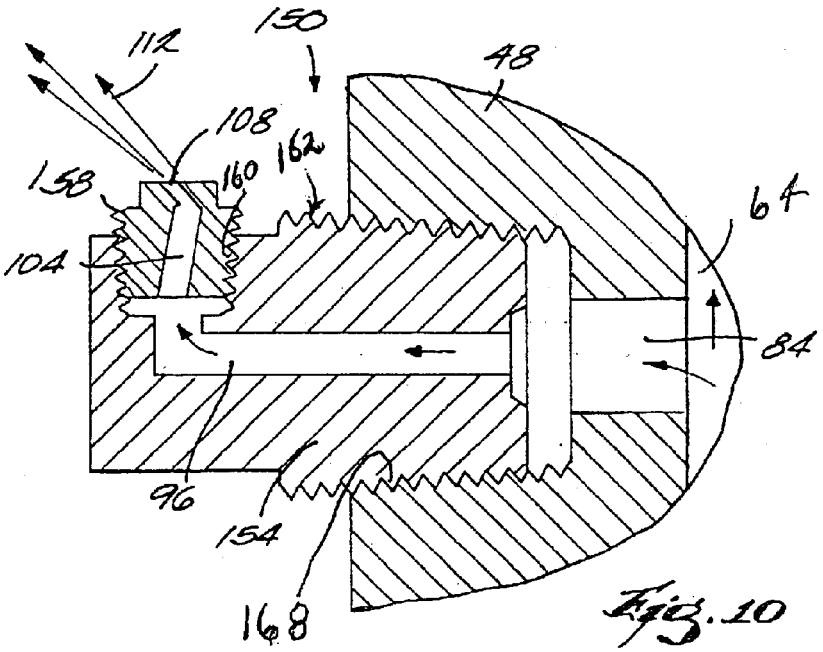
FIG. 10 is a cross-sectional view of the rear mounted spray shown in FIG. 9.

FIGS. 9 and 10 illustrate yet another embodiment of the dust reduction unit 88 shown in FIGS. 1 through 8. Like parts from the earlier embodiment are labeled with the same numbers for ease of reference.

The dust reduction unit 150 in this embodiment includes two components, a spray mount 154 and a spray nozzle 158. The spray nozzle 158 has a male pipe thread and fits into a female pipe threaded socket in the side of the spray mount 154. The spray mount 154 has a body 162 that is threaded into a rear nozzle cavity 168 in the base rear portion 48. The threaded rear nozzle cavity has an internal spray nozzle cavity water passageway 84 in communication with the mounting base rear portion internal water passageway 64.

The dust reduction unit spray nozzle 158 further includes a spray orifice 108 in communication with a spray nozzle base water passageway 96. The spray nozzle 158 is rotatable in a spray nozzle cavity 160 so that the spray orifice 108 can be directed toward a particular direction before the spray nozzle is fixed in place.

More particularly, the spray mount 154 has a female pipe threaded socket oriented at an angle to the axis of the male pipe thread. The water passage 96 joins the smaller threaded socket to the end of the spray mount that fits into the base rear portion 48. Into the smaller threaded socket fits the pipe thread of the spray nozzle 158. The spray nozzle 158 has a spray orifice 108 which is oriented at an angle to the axis of the spray nozzle's threads. By varying the amount that the spray mount is tightened into the bit holder, and the amount that the spray nozzle is tightened into the spray mount, the spray may be aimed in a wide range of orientations. Again, a simple alignment jig (not shown) can be used to position the spray nozzle 158 in the proper location so that the dust reduction water spray 112 can be directed toward the next bit assembly 13 on the drum 11.

Various other features and advantages of the invention will be apparent from the following claims.

What is claimed is:

1. An assembly for mounting a cutter bit on a driven mechanism, said assembly comprising:

a bit, a bit holder including a holding portion adapted to receive said bit, said bit holder having a bit mounting base having a forward portion and a mounting base rear portion having an internal water passageway, and a rear surface having a spray nozzle cavity in the rear surface and open in a rearward direction, said spray nozzle cavity having an internal spray nozzle cavity water passageway in communication with the mounting base rear portion internal water passageway, a dust reduction unit including a spray nozzle comprising a base received in said spray nozzle cavity and having a spray nozzle base water passageway through said spray nozzle base and in communication with said spray nozzle cavity water passageway, and a spray orifice in communication with said spray nozzle base water passageway, and means for connecting the spray nozzle to the mounting base rear portion.

2. An assembly in accordance with claim 1 wherein said assembly further comprises a bit sleeve, and wherein said mounting base has a socket adapted to receive said bit sleeve, and wherein said bit holder holding portion is said bit sleeve.

3. An assembly in accordance with claim 1 wherein said assembly further comprises a screen located between the spray nozzle cavity and said spray nozzle base water passageway.

4. An assembly in accordance with claim 1 wherein said assembly further comprises a seal between the spray nozzle base and the spray nozzle cavity.

5. An assembly in accordance with claim 1 wherein said means for connecting the spray nozzle to the mounting base rear portion is a bolt passing through said spray nozzle base bore and secured in said mounting base rear portion.

6. An assembly in accordance with claim 1 wherein said means for connecting the spray nozzle to the mounting base rear portion is a weld between the spray nozzle and said mounting base rear portion.

7. An assembly for mounting a cutter bit on a driven mechanism, said assembly comprising:

a bit having a bit tip, a bit sleeve including a holding portion adapted to receive said bit, a bore through said holding portion, an ignition control unit including a spray outlet having an internal bore, a bit holder including means for releasably securing said ignition control unit to said rear portion in the form of a retainer, a mounting base having a forward portion having an upwardly open socket adapted to receive said bit sleeve so that said bit tip extends in a forward direction, and an opening to the interior end of the upwardly open socket to assist in removal of the bit sleeve, and a mounting base rear portion having an upper opening for receiving the ignition control unit, an internal water passageway in communication with the upper opening for receiving the ignition control unit, and a rear surface having a spray nozzle cavity in the rear surface and open in a rearward direction, said spray nozzle cavity having an internal spray nozzle cavity water passageway in communication with the mounting base rear portion internal water passageway, a dust reduction unit including a spray nozzle having a spray nozzle base bore, a base received in said spray nozzle cavity, a spray nozzle base water passageway through said spray nozzle base and in communication with said spray nozzle cavity water passageway, and a spray orifice in communication with said spray nozzle base water passageway, said spray nozzle being rotatable in said spray nozzle cavity so that said spray orifice can be directed toward a particular direction before said spray nozzle is fixed in place, and means for connecting the spray nozzle to the mounting base rear portion.

8. An assembly in accordance with claim 7 wherein said assembly further comprises a screen located between the spray nozzle cavity and said spray nozzle base water passageway.

9. An assembly in accordance with claim 7 wherein said assembly further comprises a seal between the spray nozzle base and the spray nozzle cavity.

10. An assembly in accordance with claim 7 wherein said means for connecting the spray nozzle to the mounting base rear portion is a bolt passing through said spray nozzle base bore and secured in said mounting base rear portion.

11. An assembly in accordance with claim 7 wherein said means for connecting the spray nozzle to the mounting base rear portion is a weld between the spray nozzle and said mounting base rear portion.

* * * * *